US006247257B1

(12) United States Patent
Powell

(10) Patent No.: US 6,247,257 B1
(45) Date of Patent: Jun. 19, 2001

(54) DISPLAY PLATE ATTACHABLE TO A REAR OF AN AUTOMOBILE

(76) Inventor: Jon R. Powell, 3809 Fuchsia La., Modesto, CA (US) 95356

( * ) Notice: Subject to any disclaimer, the term of this patent is extended or adjusted under 35 U.S.C. 154(b) by 0 days.

(21) Appl. No.: 09/384,307

(22) Filed: Aug. 26, 1999

(51) Int. Cl.[7] ..... G09F 21/04
(52) U.S. Cl. ..... 40/591; 280/507
(58) Field of Search ..... D12/162, 172; 280/507; 40/591, 592

(56) References Cited

U.S. PATENT DOCUMENTS

| | | | | |
|---|---|---|---|---|
| D. 189,713 | | 2/1961 | Brandt . | |
| D. 204,727 | * | 5/1966 | Diehl | 40/592 X |
| 2,496,763 | | 2/1950 | Whaley . | |
| 3,153,294 | * | 10/1964 | Hay et al. | 40/592 |
| 3,234,677 | * | 2/1966 | McDaniel et al. | 40/592 |
| 3,509,653 | | 5/1970 | Hummel . | |
| 3,782,761 | | 1/1974 | Cardin, Sr. . | |
| 4,736,539 | | 4/1988 | Dickinson . | |
| 4,955,153 | | 9/1990 | Albrecht et al. . | |
| 5,092,503 | | 3/1992 | Cocks . | |
| 5,603,178 | | 2/1997 | Morrison . | |
| 6,079,136 | * | 6/2000 | Kozlarek | 280/507 X |

* cited by examiner

*Primary Examiner*—Joanne Silbermann
(74) *Attorney, Agent, or Firm*—Heisler & Associates

(57) ABSTRACT

A display plate kit 10 is provided which allows a message display plate 20 to be attached to the rear bumper B of a vehicle V in various modes without the use of adhesives. In a first mode, the plate 20 may be attached to a tow ball T on a vehicle V by means of a top tab 30 having a slot 35 to receive a post P of the tow ball T which is threadably secured to a tow ball nut N. In a second mode, the plate 20 may be attached by means of bottom tabs 40 with holes 45 whose spacing corresponds to those of a standard license plate L so that the same screws 47 used to attach the license plate L to the vehicle V may be used to secure the display plate 20 to the front or rear bumper B of the vehicle V. In a third mode, the display plate 20 may be attached to a receiver R extending from a vehicle V by means of a tube 60 which is attachable to a front surface 24 of the display plate 20 and slidably mates with the receiver R. The kit 10 of the present invention includes lettering having a variety of font styles and colors to allows various messages to be adhesively attached to surfaces 22, 24 of the display plate 20. An alternative kit 110 is also provided which has a display plate 120 with a pair of slots 150 located on the front surface 124 of the display plate 120. A receiver insert tube 160 is provided with a mounting plate 180 attached to a rear face of the tube 160. The mounting plate 180 has ears 190 extending laterally therefrom which can slide into the slots 180 so that the receiver insert tube 160 is removably attachable to the front surface 124 of the display plate 120.

17 Claims, 5 Drawing Sheets

DISPLAY PLATE ATTACHABLE TO A REAR OF AN AUTOMOBILE

FIELD OF THE INVENTION

The present invention relates to display plates for vehicles. More particularly, this invention relates to display plates for vehicles which may be removably installed adjacent the rear bumper.

BACKGROUND OF THE INVENTION

Messages are frequently displayed on moving vehicles by applying rectangular strips of paper with printed messages to the rear vehicle bumpers, using an adhesive. These message display sheets are commonly known as "bumper stickers." Bumper stickers are difficult to remove and frequently leave unsightly patches of adhesive on the exterior finish of a vehicle after removal.

A general trend toward maintaining a cleaner and less cluttered vehicle appearance, especially on newer cars, has reduced the use of bumper stickers in favor of other removable display devices. The prior art describes display plates which are attached to the vehicle trunk lid or rear bumper by means of an adjustable hook clip (Brandt, U.S. Pat. No. D189,713; Hummel, U.S. Pat. No. 3,509,653). Other prior art describes display signs which are adhesively attached to the inside surface of a vehicle window (Albrecht, U.S. Pat. No. 4,955,153). Still other prior art describes a bumper sticker holder, including a base plate and peripheral frame, which is threadably attached to the bumper of a vehicle (Dickinson, U.S. Pat. No. 4,736,539). Additionally, Morrison (U.S. Pat. No. 5,603,178) describes an ornamental cover for tubular trailer hitch sockets, also known as receivers, where the primary purpose of the cover is to conceal the undecorated opening of the trailer hitch socket while not in use. Morrison's cover is releasably attached to the trailer hitch socket by a threaded ear. A rectangular plate with printed text or graphics is joined to the end of the ear. Morrison's cover may only be used with tubular trailer hitch sockets.

Generally, vehicle display systems described in the prior art are suited to only one primary method of attachment. Automobiles vary widely in rear end configuration, such that no one system of attachment can be universally effective. Accordingly, a need exists for a vehicle message display plate which can be easily installed and removed, will fit a variety of vehicle types, and has multiple modes of installation and attachment.

SUMMARY OF THE INVENTION

The present invention is a kit for mounting a versatile message display plate adjacent the rear bumper of a vehicle without using adhesives or other permanent mounting means. The display plate of the present invention includes multiple attachment elements which allow the plate to be deployed in a variety of modes.

In a first mounting mode, the message display plate is secured to a vehicle ball-type trailer hitch or bumper by means of a top tab which extends laterally from the front surface of the display plate. In this first mode, a threaded post of the trailer hitch tow ball is passed through a hole in the tab. The tow ball post is then threadably secured in a hole in the trailer hitch tongue or vehicle bumper using a tow ball nut.

In a second mounting mode, the display plate may be secured to the top or bottom of a standard vehicle license plate attachment point by means of two bottom tabs with holes whose spacing corresponds to those of a standard license plate. The display plate may be mounted with the same screws used to secure the license plate. The display plate can be oriented such that it is located directly above or directly below the vehicle license plate. When the vehicle is not registered or otherwise the law allows, the display plate can be located covering the vehicle license plate. The tab may be lightly scored to allow precise removal from the edge of the display plate to accommodate other mounting modes.

In a third mounting mode, the display plate of the present invention may be mounted in a square receiver socket of a vehicle trailer hitch. A separate tubular element is provided which may be mounted to the front surface of the display plate using an appropriate adhesive or other coupling. The tubular element has a square cross-section to match the interior shape of the receiver socket. The tubular element is attached to extend perpendicularly from the front of the display plate of the present invention to slidably mate with the receiver. Corresponding bore holes within both the tubular element and the receiver are aligned to accept a cylindrical pin to securely mate the display plate with the trailer hitch.

The kit of the present invention also includes a variety of letters and numerals of differing colors and font styles which may be adhesively attached to the rear surface of the display plate to spell an identifiable message. Alternatively, the rear surface can have standard sayings or other decorative material pre-printed thereon.

OBJECTS OF THE INVENTION

A primary object of the present invention is to provide a vehicle message display plate which may be easily installed and removed in a variety of mounting modes on a variety of vehicles without the use of adhesives.

Another object of the present invention is to provide a vehicle message display plate which includes multiple attachment elements that can be removed from the base structure of the plate when not needed or added when needed.

Another object of the present invention is to provide a vehicle message display plate whose message may be quickly and easily modified.

Another object of the present invention is to provide a vehicle message display plate whose lettering design and color may be easily modified.

Another object of the present invention is to provide a vehicle message display plate to cover a generally unattractive open end of a tubular trailer hitch socket as well as the spare tire and rear differential.

Another object of the present invention is to provide a vehicle message display plate that can be installed to the existing license plate of a vehicle.

Another object of the present invention is to provide a vehicle message display plate constructed of rigid polycarbonate material able to withstand the deleterious effects of the sun's rays and other forms of weathering.

Another objective of the present invention is to provide a cover for a tubular trailer hitch socket which prevents unwanted entry of dirt into the socket.

Another object of the present invention is to provide a vehicle message display plate of simple and reliable manufacture made of readily available material.

Other further objects of the present invention will become apparent from a careful reading of the included drawing figures, the claims and detailed description of the invention.

DESCRIPTION OF THE PREFERRED EMBODIMENT

Figure 1:
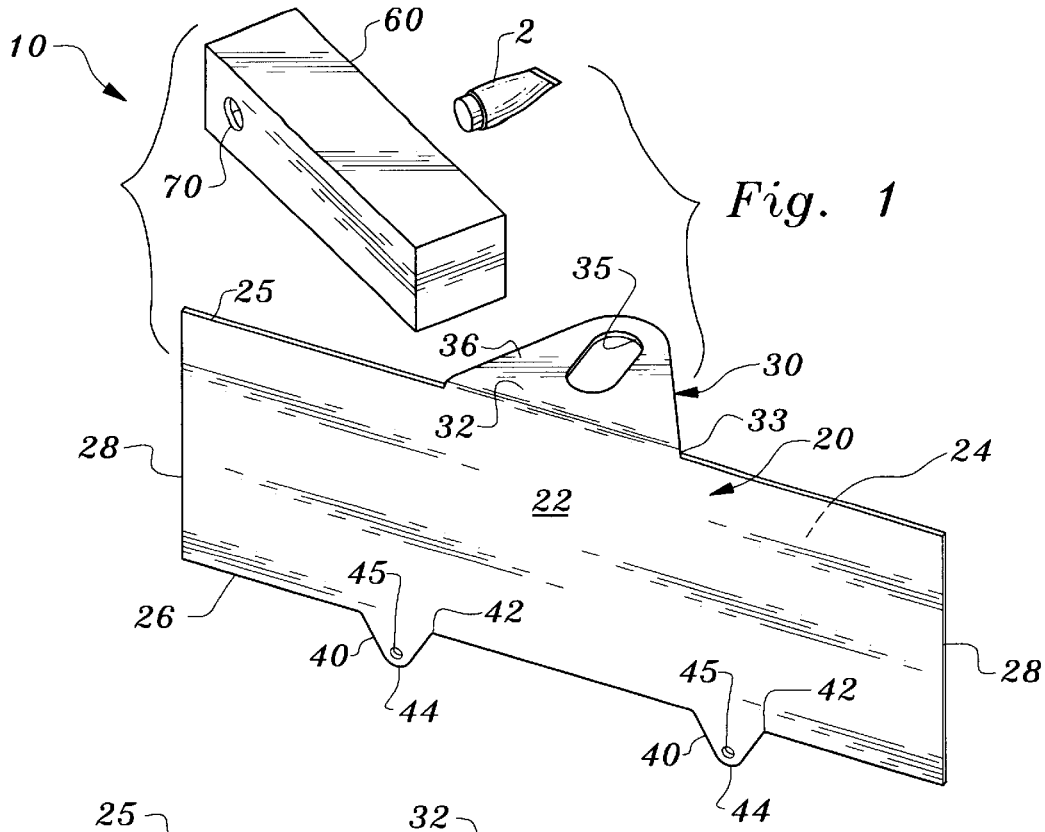
FIG. 1 is a front perspective view of the various different parts of the display plate kit of the present invention.

Referring to the drawings, wherein like reference numerals represent like parts throughout the various drawing figures, reference numeral 10 (FIG. 1) is directed to a kit for releasably attaching a message display plate 20 to the rear of a vehicle V. The kit 10 allows a display plate 20 to be mounted to a vehicle V bumper B without using adhesives to join the plate 20 to the bumper B.

In essence, and with initial reference to FIG. 1, the kit 10 of the present invention includes a generally rectangular plate 20 which provides both a rear surface 22 to display a message and a foundation to support various elements for attaching the plate 20 adjacent a bumper B of the vehicle V. One attachment element, a top tab 30, extends perpendicularly from a top edge 25 of the plate 20. Further attachment elements, two bottom tabs 40, extend from a bottom edge 26 of the plate 20. Lettering may be adhesively attached to a rear surface 22 of the plate 20 to display an identifiable message. A third attachment element, a separate tube 60, may be adhesively attached to a front surface 24 of the plate 20 for mating with a receiver R on the bumper B of a vehicle V. The tube 60 may be attached using an adhesive 2 suited to joining plastic materials.

Figure 2:
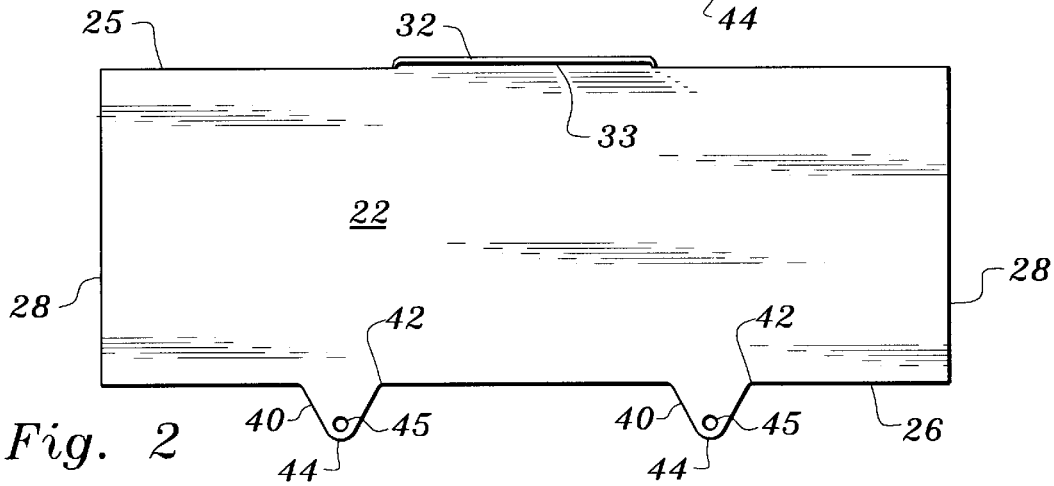
FIG. 2 is a rear elevation view of the display plate of the present invention.
Figure 3:
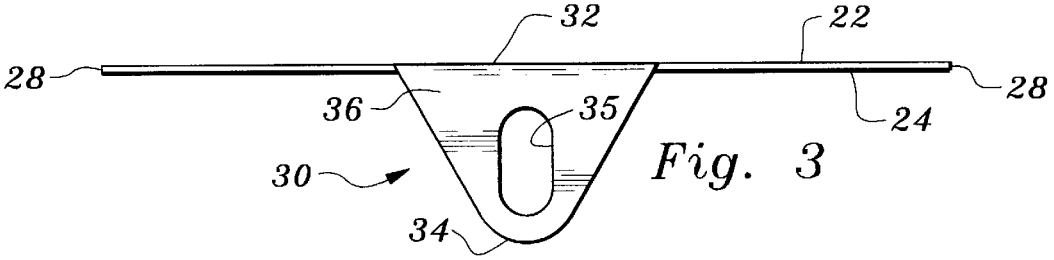
FIG. 3 is a top plan view of the display plate of the present invention.

More specifically, and with particular initial reference to FIGS. 1–3, the details of the kit 10 of the present invention are described. The kit 10 includes a message display plate 20. The plate 20 is preferably rectangular, having dimensions similar to those of a standard license plate L where the plate width is greater than its height. The plate 20 includes a rear planar surface 22 opposite an opposing and parallel front planar surface 24 (FIG. 3). An elongate top edge 25 extends between the rear surface 22 and front surface 24 of the plate 20. An opposing parallel bottom edge 26 of the plate 20 extends between the rear surface 22 and the front surface 24. The plate 20 includes two side edges 28 at either end which extend between the rear surface 22 and the front surface 24 to join the top edge 25 with the bottom edge 26.

The plate 20 and other elements of the kit 10 are preferably made of polycarbonate plastic. Such a material provides greater resistance to strength degradation caused by exposure to solar radiation than other hydrocarbon polymers and yet can still be relatively easily formed using known plastic forming techniques.

Figure 4:
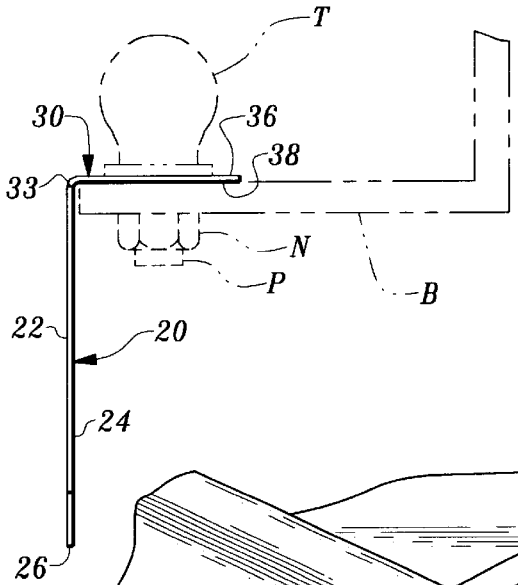
FIG. 4 is a side elevation view of the display plate of the present invention installed on a vehicle bumper by the top tab and using the tow ball assembly to hold the plate in place.

A top tab 30 preferably extends perpendicularly from an approximate midpoint of the top edge 25 of the plate 20 in a forward direction from the front surface 24 of the plate 20 (FIG. 1). The top tab 30 includes a rear edge 32 which is joined along the top edge 25 of the plate 20. The union of the rear edge 32 of the top tab 30 with the top edge 25 of the plate 20 forms a bend 33. The top tab 30 extends forward from the front surface 24 of the plate 20 and terminates in the shape of a forward curve 34 (FIG. 3). The forward curve 34 defines the perimeter of a planar top surface 36 of the tab 30 and an opposing parallel planar bottom surface 38 of the top tab 30 (FIG. 4).

Figure 5:
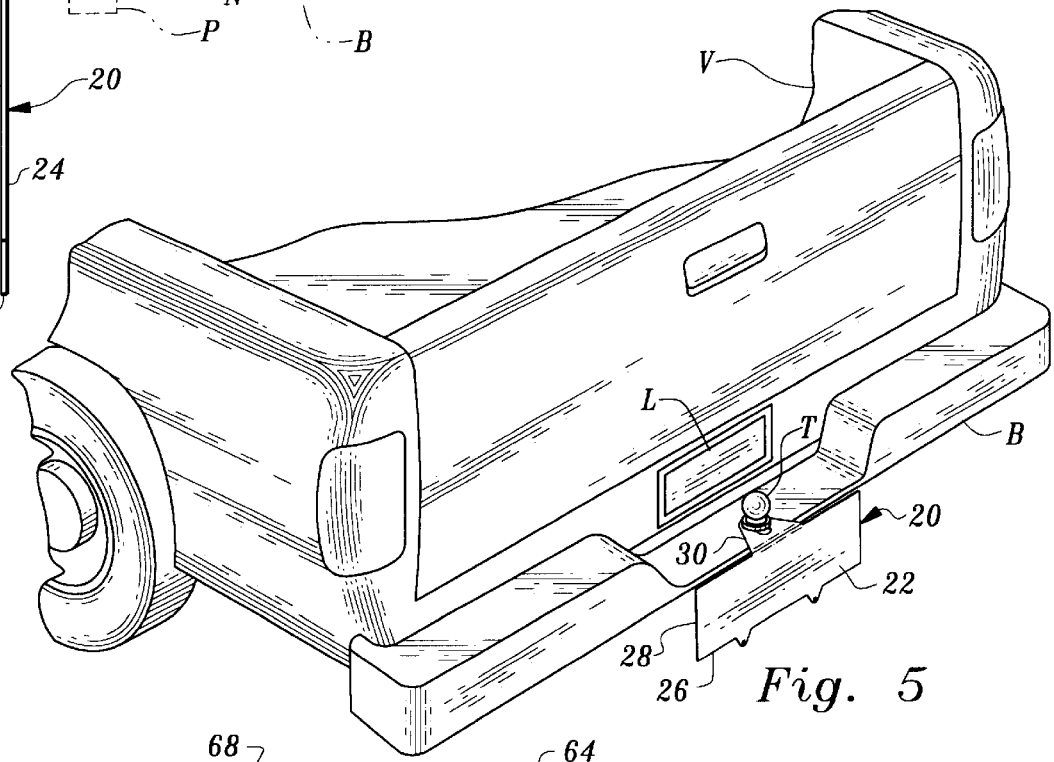
FIG. 5 is a perspective view of the display plate of the present invention installed on a vehicle rear bumper using the tow ball and top tab.
Figure 6:
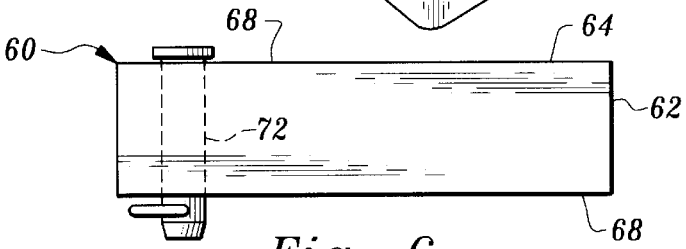
FIG. 6 is a top plan view of the tube of the present invention including a pin to hold the tube within a receiver and before the tube is adhesively attached to the front surface of the display plate.

The top and bottom surfaces 36, 38 of the top tab 30 are penetrated by a slot 35 sized to receive a post P of a typical tow ball T, but smaller than the size of the tow ball T. The slot 35 has length in a forward direction which is greater than its width. When the tab 30 is used to attach the display plate 20 to the rear bumper B of a vehicle V (FIG. 5), the elongate slot 35 allows the plate 20 to be adjusted forward or backward to accommodate bumpers B of varying sizes and configurations.

Figure 10:
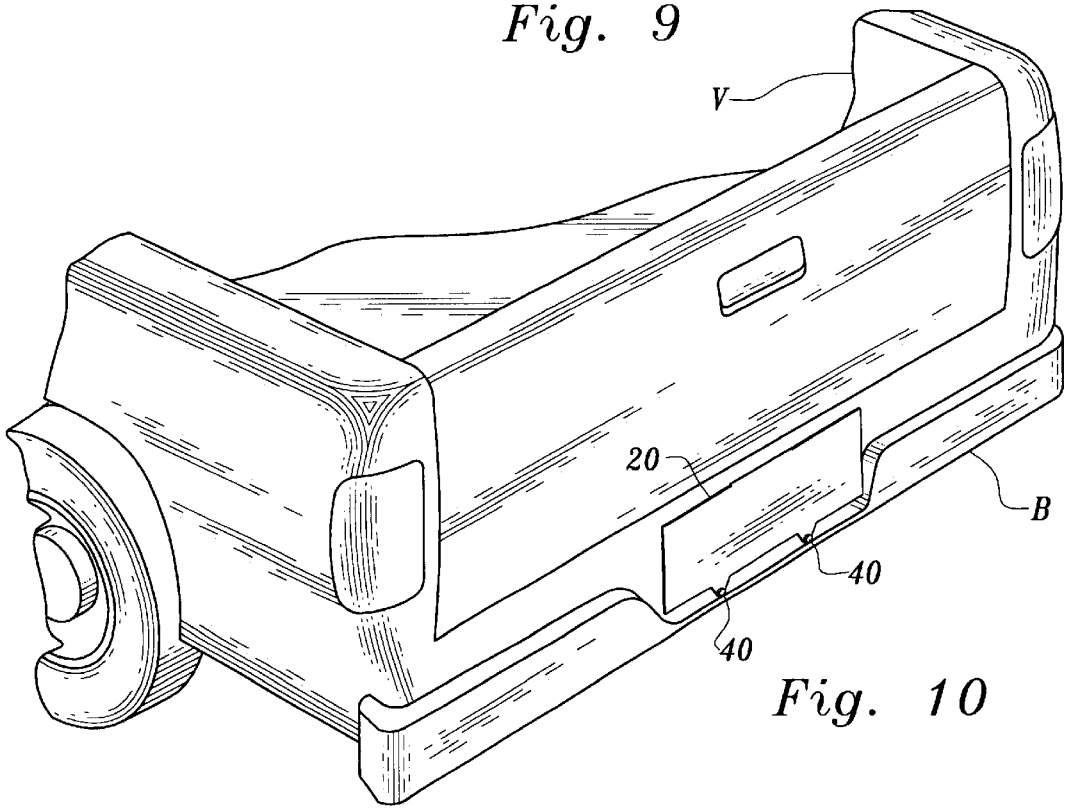
FIG. 10 is a perspective view of the display plate of the present invention installed adjacent a vehicle rear bumper using screws which secure the plate to the location typically used for attaching a standard license plate.
Figure 11:
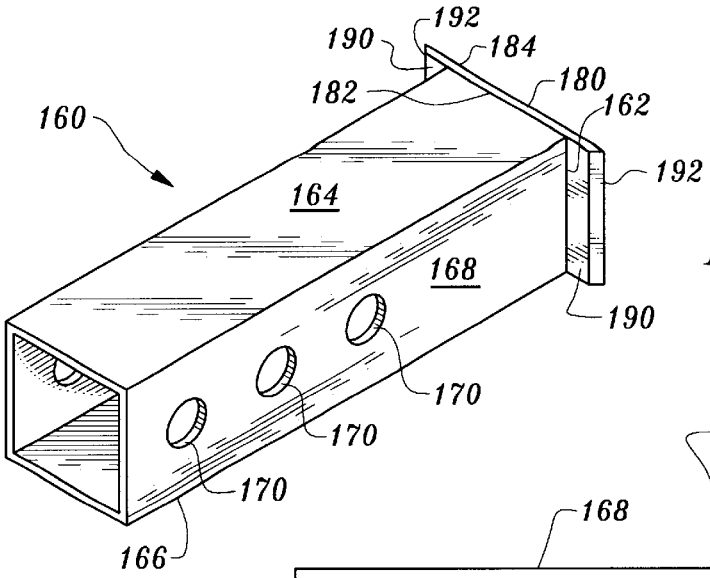
FIG. 11 is a perspective view of an alternative receiver insert tube configured to removably attach to the display plate of an alternative kit to the kit of this invention.
Figure 12:
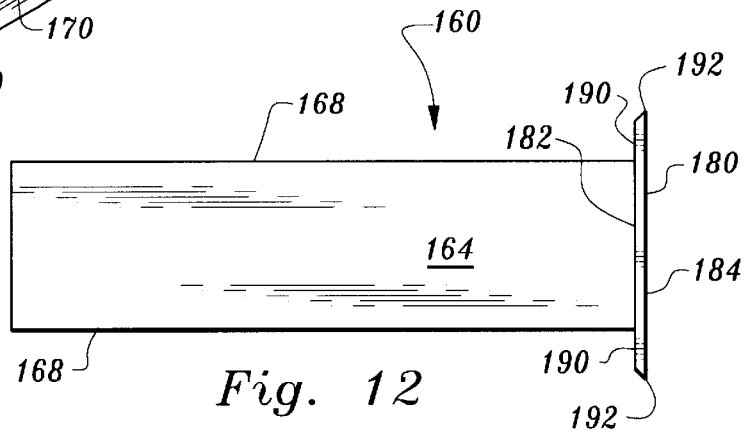
FIG. 12 is a side elevation view of that which is shown in FIG. 11.
Figure 13:
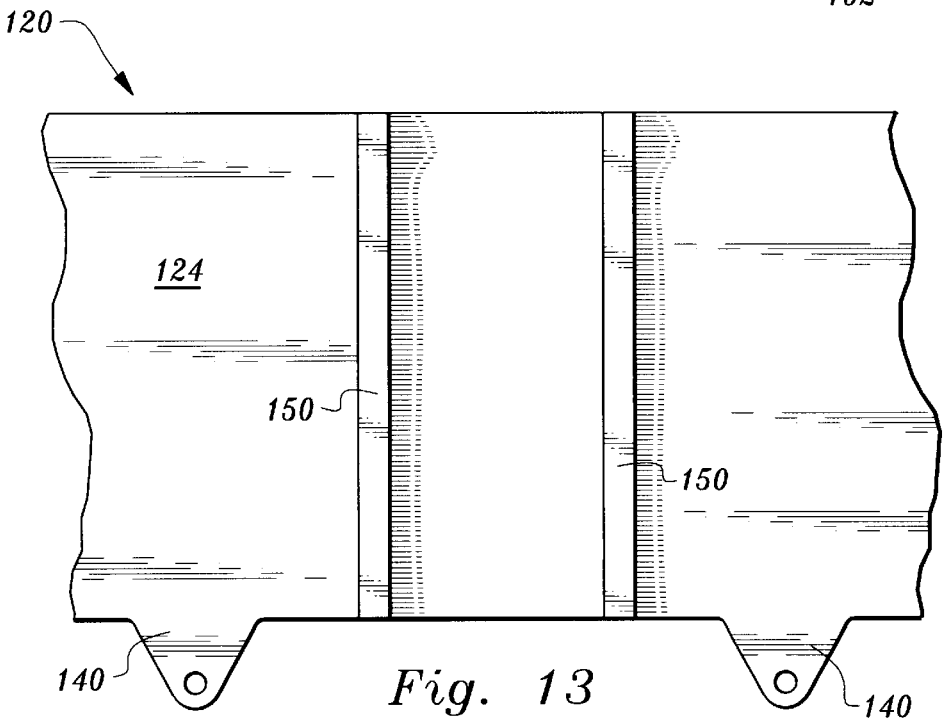
FIG. 13 is a front elevation view of the display plate of an alternative kit which includes slots therein to receive the receiver insert tube in a removably connectable fashion.
Figure 14:
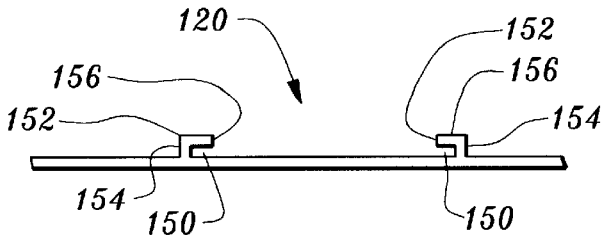
FIG. 14 is a bottom plan view of that which is shown in FIG. 13.
Figure 15:
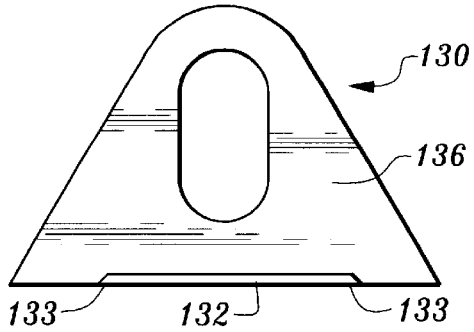
FIG. 15 is a bottom plan view of a removably attachable top tab according to the alternative kit of this invention.
Figure 16:
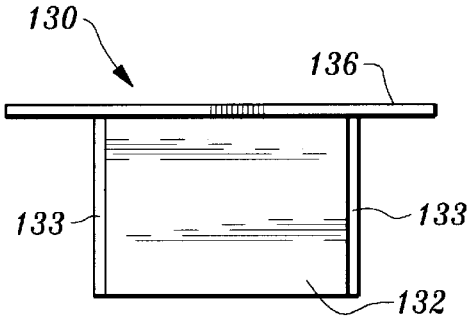
FIG. 16 is a front elevation view of that which is shown in FIG. 15.
Figure 17:
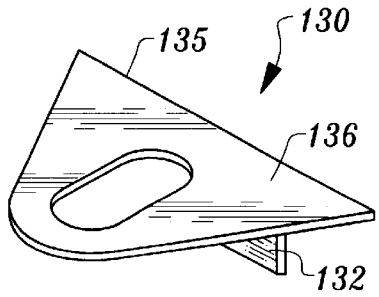
FIG. 17 is a perspective view of that which is shown in FIG. 16.
Figure 18:
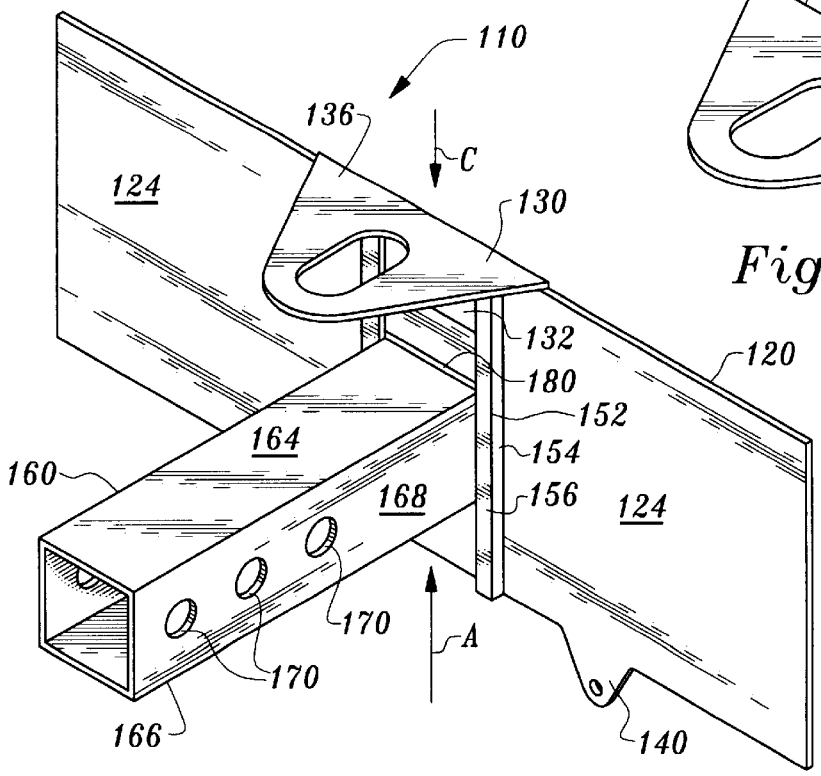
FIG. 18 is a perspective view of the entire alternative kit which features removable coupling of the receiver insert tube and the top tab with the front surface of the display plate.

Two bottom tabs 40 extend downward from the bottom edge 26 of the plate 20 (FIGS. 1 and 2). The bottom tabs have upper edges 42 which are joined to the bottom edge 26 of the plate 20. Each bottom tab 40 extends down to a lower curve 44. The lower curve 44 defines the perimeter of the bottom tab 40. Each bottom tab 40 is penetrated by a circular hole 45. The circular hole 45 has a diameter of approximately three-sixteenths of an inch to slidably accept a screw of the size commonly used to attach standard vehicle license plates L to the bumper B of a vehicle V. The bottom tabs 40 are evenly spaced along the bottom edge 26 of the plate 20 so that the holes 45 align with the threaded holes in a standard license plate mounting fixture. Hence, the same screws used to secure the license plate L to the vehicle V may be used to mount the plate 20 to the vehicle V via the bottom tabs 40 (FIG. 10). Typically, the tabs 40 will be spaced seven inches apart to correspond to the spacing of the holes in a common license plate L. While shown adjacent the rear bumper B of the vehicle V, the bottom tabs 40 could be used to attach the display plate 20 to the front bumper B also.

Individual lettering is provided with the kit 10. The lettering may be adhesively attached to the rear surface 22 of the plate 20 to spell out an identifiable message. The lettering is provided in a plurality of sizes, font types, style, colors and reflectivity to provide variability in the displayed message appearance.

Figure 7:
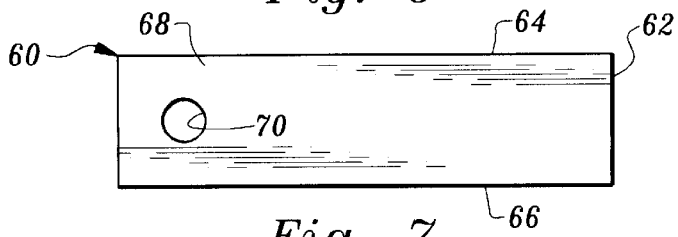
FIG. 7 is a side elevation view of that which is shown in FIG. 6, without the pin.
Figure 8:
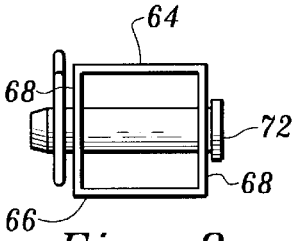
FIG. 8 is an end view of that which is shown in FIG. 6.
Figure 9:
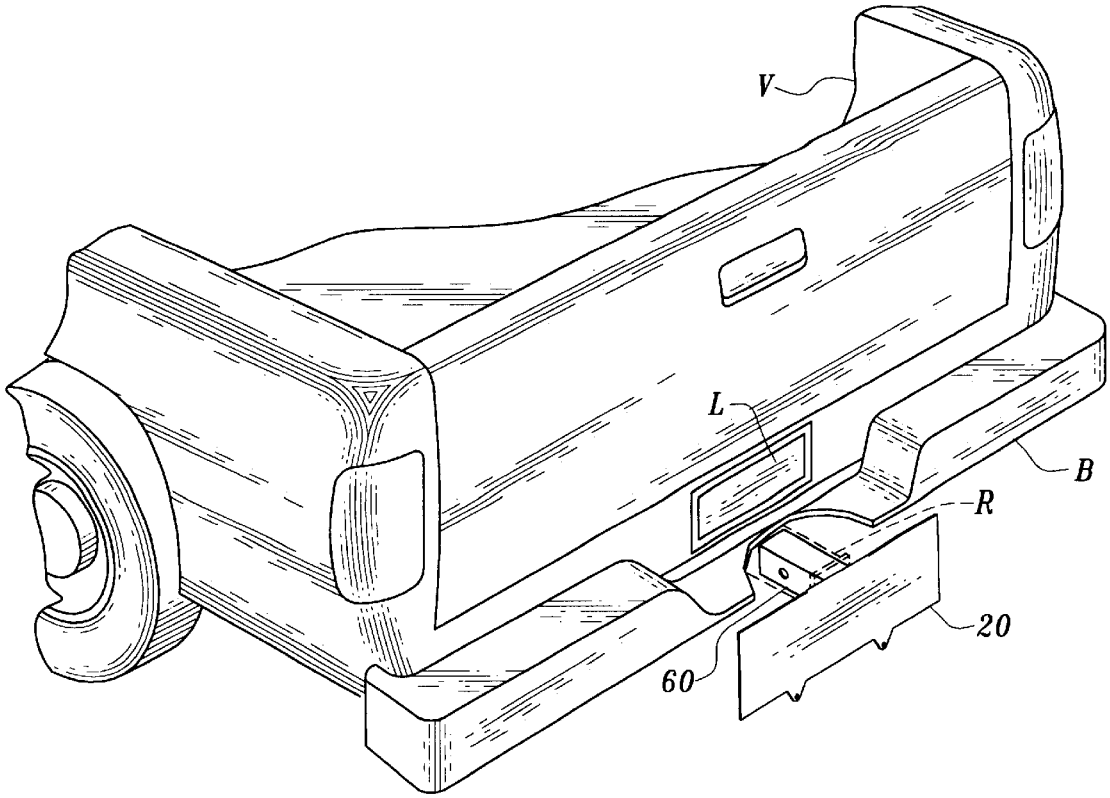
FIG. 9 is a perspective view of the display plate of the present invention mounted adjacent a vehicle rear bumper using the tube to releasably mate with the receiver.

As most clearly shown in FIGS. 6–9, a separate tubular element 60 is provided which may be attached with an adhesive 2 (FIG. 1) along a rear face 62 to extend forward from the front surface 24 of the plate 20. The tube 60 has a generally square cross-section (FIG. 8) to match the interior shape of a receiver R of a socket-type trailer hitch (FIG. 9). The tube 60 is sized to slidably telescope within the receiver R. The tube 60 includes a substantially rectangular top wall 64 opposite a substantially equivalent and parallel bottom wall 66 (FIG. 7). Two side walls 68 extend perpendicularly between and join the top and bottom walls 64, 66 to form the tube 60. The side walls 68 are penetrated by bores 70 (FIG. 7) which correspond with holes in the receiver R. The bores 70 in the tube 60 are spaced a distance from the rear face 62 of the tube 60 approximately equal to the spacing of the holes from a rear end of the receiver R. The tube 60 is releasably secured to the receiver R by a pin 72 (FIGS. 6 and 8) which simultaneously passes through the bores 70 in the tube 60 and the holes in the receiver R (FIG. 9).

In use and operation, the kit 10 provides various modes by which the plate 20 may be mounted adjacent the rear bumper B of a vehicle V. In a first mode (FIG. 5), the plate 20 may be mounted adjacent the bumper B of the vehicle V by means of the top tab 30. Where the vehicle V includes a tow ball T, the tow ball T is first removed from the bumper B. A post P of the tow ball T is then passed through the slot 35 in the tab 30. The tow ball T is then reattached to the bumper B of the vehicle V using a tow ball nut N which threads onto the post P of the tow ball T (FIG. 4). The top tab 30 is sandwiched between the upper surface of the bumper B of the vehicle V and the lower surface of the tow ball T (FIG. 4). In this mounting mode, the plate 20 may be oriented to extend downward (FIG. 5) or upward from point of attachment of the top tab 30.

In a second mounting mode (FIG. 10), the plate 20 may be mounted using the bottom tabs 40. The bottom tabs 40 and their holes 45 are spaced to correspond to typical spacing of holes in a common license plate L. Screws are passed through the holes 45 in the bottom tabs 40 and threaded into the holes in a typical license plate L mounting fixture on the vehicle V to secure the plate 20 adjacent the bumper B (FIG. 10). In this mode, the plate 20 may be attached to upper or lower holes in the license plate L fixture. Additionally, the plate 20 may be attached over the existing license plate L space in place of the license plate L, or to overlie the license plate L when the vehicle is unregistered or otherwise can legally have the license plate L covered (FIG. 10). Further, the plate 20 may be positioned to extend up or down from the upper or lower holes in the license plate L fixture, depending on the size and configuration of the bumper B of the vehicle V.

Still further, the plate 20 may be installed upside down with the top tab 30 on bottom pointing forward, which eliminates the need to remove the top tab 30 from the plate 20. The lettering would still be placed on the rear surface 22. However, in some cases the top tab 30 may be removed from the plate 20 by bending the top tab 30 along a scored portion in the bend 33 formed by the union of the top tab 30 with the top edge 25 of the plate 20. Alternatively, as shown in FIGS. 15–18, an alternative top tab 130 can be configured to be removably attached to an alternative display plate 120 as described below.

In a third mounting mode (FIG. 9), the plate 20 may be mounted adjacent the rear bumper B of a vehicle V using the tube 60 provided in the kit 10 (FIG. 1). This mounting mode presupposes attachment to the bumper B of a vehicle V which includes a receiver R designed to hold a removable tow ball (FIG. 9). Before mounting in this mode, the rear face 62 of the tube 60 is adhesively attached to the front surface 24 of the plate 20 using adhesive 2 (FIG. 1). The tube 60 is preferably joined at a center point of the front surface 25 to extend perpendicularly from the front surface 25 (FIG. 9). Depending on the particular configuration of the bumper B of the vehicle V, the top tab 30 may or may not need to be removed. The tube 60 is slid into the interior of the receiver R so that the bores 70 in the sidewalls 68 of the tube 60 align with corresponding holes in the receiver R (FIG. 9). A pin 72 (FIGS. 6 and 8) is then passed through the bore 60 and holes to securely engage the plate 20 with the receiver R.

Individual lettering provided in the kit 10 may be adhesively applied to either the front surface 24 or rear surface 22 of the plate 20 to spell out an identifiable message. The preferred surface 22, 24 will depend upon the mounting orientation of the plate 20. The adhesive may either be applied to the lettering, or, the lettering may come with preapplied adhesive. Also, bumper stickers can be attached to the rear surface 22 or the rear surface 22 can be preprinted with a desired logo or other message or design.

With particular reference to FIGS. 11–18, details of an alternative kit 110 of this invention are provided which facilitates a variation on the third mode (FIG. 9) of attachment of an alternative display plate 120 to a rear bumper B of a vehicle V through a receiver R. Specifically, a receiver insert tube 160 is provided similar to the tube 60 of the preferred embodiment except that the receiver insert tube 160 includes a mounting plate 180 adjacent the rear face 162 of the tube 160. The receiver insert tube 160 additionally preferably includes at least three bores 170 linearly spaced from each other so that the receiver insert tube 160 can be attached at various different positions relative to the receiver R.

The mounting plate 180 preferably has a height similar to a distance between a top wall 164 and a bottom wall 166 of the receiver insert tube 160. The mounting plate 180 preferably extends beyond the side walls 168 of the receiver insert tube 160. Hence, the mounting plate 180 includes ears 160 extending laterally beyond the side walls 168 of the tube 160. The mounting plate 180 includes a front side 182 affixed to the rear face 162 of the tube 160. A back side 184 of the mounting plate 180 is not permanently affixed to any other structures but rather is exposed. This backside 184 is preferably substantially flat.

The ears 190 extend laterally away from the side walls 168 of the tube 160 to tips 192. Preferably, the tips 192 are tapered to a point. In contrast to the third mounting mode (FIG. 9) of the preferred embodiment, with the alternative kit 110, the receiver insert tube 160 is not permanently affixed to the display plate 120. Rather, a front surface 124 of the display plate 120 is provided with slots 180 into which the ears 190 of the mounting plate 180 can slide, so that the tube 160 is securely, but removably, attached to the display plate 120. The display plate 120 is similar in form to the display plate 20 of the preferred embodiment except for the existence of the slots 180 on the front surface 124 of the display plate 120. Hence, the display plate 120 includes a top tab 130 and bottom tabs 140.

The slots 150 are formed by brackets 152 which extend perpendicularly away from the front surface 124 in the form of risers 154 and then extend horizontally parallel to the front surface 124 in the form of overlaps 156. The slots 150 are between the overlaps 156 and the front surface 124. Two slots 150 are provided beneath two parallel brackets 152 which extend vertically along the front surface 124 and beneath the top tab 130. The distance between the risers 154 of the brackets 152 is just slightly greater than a width of the mounting plate 180 on the tube 160. The distance between the closest tips of the overlaps 156 of each bracket 152 is less than a lateral width of the mounting plate 180. Hence, the mounting plate 180 can be positioned with the ears 190 within the slots 150 and have the ears 190 retained within the slots 150.

A distance between the overlaps 156 and the front surface 124 is preferably substantially similar to a thickness of the ears 190 of the mounting plate 180. Hence, a friction fit is provided when the ears 190 of the mounting plate 180 are slid into the slots 150, such as along arrow A of FIG. 18. The tips 192 of the ears 190 are preferably tapered to assist in sliding the mounting plate 180 of the tube 160 into the slots 150 of the display plate 120.

Preferably, detents are formed in both the front side 182 of the ears 190 and in the overlaps 156 of the brackets 152 which cooperate with each other. These detents or other stops allow the mounting plate 180 to securely register at a desired location substantially at a midpoint on the front surface 124 of the display plate 120. Preferably, the mounting plate 180 and brackets 152 are formed from materials which are substantially rigid but can flex enough so that the detents or other stops on the mounting plate 180 and the brackets 152 can slide through the slots 150 until the detents or stops register together at the desired location for positioning of the tube 160 within the slots 150.

The tube 160 and display plate 120 are thus capable of being securely attached together. However, the display plate 120 can be removed from the receiver insert tube 160 by merely reversing the attachment process by forcing the mounting plate 180 of the tube 160 down out of the slots 150 on the display plate 120. With this alternative kit 110, a user can have multiple different display plates 120 and slide them onto and off of a single receiver insert tube 160 without requiring purchase of multiple different receiver insert tubes 160. If the display plate 120 is provided without the top tab 130, display plates 120 remain which are entirely planar such that less space is taken up by the display plate 120 within store inventory or warehouse inventory.

While the top tab 130 can be configured as shown in FIGS. 1–10 according to the preferred embodiment, the top tab 130 is preferably configured as a removably attachable top tab 130, shown best in FIGS. 15–18. The removably attachable top tab 130 has the same configuration as the top tab 30 of the preferred embodiment except that it is not integrally formed with the display plate 120. Rather, the top tab 130 includes a top plate 136 extending horizontally and perpendicularly away from a vertically oriented back plate 132. The back plate 132 has a width similar to a width of the mounting plate 180 with lateral edges 133 configured similar to the tips 192 of the ears 190. Hence, the back plate 132 can slide vertically down into the slot 150, along arrow C of FIG. 18. As with the receiver insert tube 160, the top tab 130 is thus removably attachable into the same slots 150 between the brackets 152 for removable attachment to the display plate 120.

The back plate 132 and the mounting plate 180 provide two forms of a mounting structure for a vehicle coupling such as the top tab 130 or the hitch receiver insert tube 160. Other vehicle couplings and mounting structures could similarly be utilized. Detents or other stops can be complementally formed between the brackets 152 and the back plate 132, in a manner similar to that discussed above with regard to the ears 190, so that an appropriate friction fit and secure attachment occurs between the top tab 130 and the display plate 120.

In one variation on the alternative kit 110, multiple different display plates 120 can be provided such as with each display plate having a message which corresponds with a holiday or season of the year. A user of the alternative kit 110 could merely remove the display plate 120 off of the receiver insert tube 160 or off of the top tab 130 and attach a new display plate having the message most appropriate for the current season. A seasonally appropriate greeting could then be consistently displayed from the rear of the vehicle (i.e. Merry Christmas, Happy New Year, Happy Valentine's Day, Happy Easter, Happy 4th of July, Happy Halloween, etc.).

While the alternative embodiment of FIGS. 11–18 is identified as an alternative embodiment, at the time of filing this application this alternative embodiment of FIGS. 11–18 is considered by the inventor to be the best mode for practicing this invention.

This disclosure is provided to reveal a preferred embodiment of the invention and a best mode for practicing the invention. Having thus described the invention in this way, it should be apparent that various different modifications can be made to the preferred embodiment without departing from the scope and spirit of this disclosure. When structures are identified as a means to perform a function, the identification is intended to include all structures which can perform the function specified.

What is claimed is:

1. A system for supporting a display plate on a rear of a vehicle having a hitch receiver thereon, the system comprising in combination:

a display plate having a front surface opposite a rear surface, said rear surface capable of supporting visually perceptible images thereon;

a receiver insert having an elongate form with a cross-section similar to an interior of the hitch receiver of the vehicle, such that said insert can telescope into and out of the hitch receiver;

at least one bore passing laterally into said insert, such that a pin can pass through both a hole in said receiver and said bore to couple said insert with the hitch receiver;

a coupling for removably attaching a rear face of said receiver insert to said front face of said display plate; and wherein said coupling includes at least one slot on said front face of said display plate and at least one ear on said rear face of said receiver insert, said ear sized to fit complementally within said slot to removably couple said receiver insert to said front surface of said display plate.

2. The system of claim 1 wherein said front surface of said display plate includes two slots therein which face each other; and wherein said rear face of said receiver insert includes two ears extending away from each other.

3. The system of claim 2 wherein said two slots are parallel to each other and spaced apart a distance similar to a distance between said two ears of said receiver insert.

4. The system of claim 1 wherein said ear and said slot are sized such that they frictionally fit together in a secure fashion.

5. The system of claim 4 wherein said two slots are oriented vertically.

6. The system of claim 5 wherein said slots are spaced an equal distance from a centerline of said display plate such that a center of said display plate is between said slots.

7. The system of claim 2 wherein said slots are formed from brackets extending forward from said front surface of said display plate, said brackets each including a riser extending perpendicularly away from said front surface of said display plate and an overlap extending from a tip of said riser opposite said front surface of said display plate and parallel to said front surface of said display plate, said overlap spaced from said front surface of said display plate by a height of said riser defining a thickness of said slot, said brackets having a constant cross-sectional form and extending from a bottom edge of said display plate up to at least a midpoint of said display plate.

8. The system of claim 7 wherein said overlaps of said brackets include detents which alter a cross-sectional form of said slots, said ears of said mounting plate on said rear face of said receiver insert including complementally formed detents therein which can be aligned with said detents in said overlaps of said brackets, such that said ears can be secured within said slots when said detents of said ears are aligned with said detents in said overlaps of said slots.

9. The system of claim 2 wherein said ears extend to tips at lateral extremities of said ears, said tips tapered such that said tips have a lesser thickness than portions of said ears spaced away from said tips.

10. A method for suspending a display plate from a rear of a vehicle having a hitch receiver thereon the method including the steps of:

providing a display plate having a front surface opposite a rear surface, the front surface capable of supporting visually perceptible images thereon;

providing a receiver insert having an elongate form with a cross-section similar to an interior of the hitch receiver of the vehicle, such that the insert can telescope into and out of the hitch receiver;

providing a first part of a two part removable coupling on the front surface of the display plate;

providing a second part of the coupling on the rear face of the receiver insert;

configuring the first part and the second part to be removably attachable to each other; and configuring the first part of said removable coupling as a slot and configuring said second part of said removable coupling as a mounting plate having ears at extremities thereof conforming to a size of the slot.

11. The method of claim 10 including the further step of configuring the ears to slide into and out of the slot with the slot restricting motion other than sliding motion between the ears and the slot.

12. The method of claim 10 including the further step of forming the slot as a space between two brackets, said brackets spaced apart by a distance similar to a distance between tips of the ears.

13. An apparatus for providing a display on a rear of a vehicle, the apparatus comprising in combination:

a display plate having a front surface opposite a rear surface, said rear surface capable of supporting a display thereon;

a pair of slots on said front surface of said display plate, said slots oriented substantially parallel to each other;

a vehicle coupling having a mounting structure between said slots similar in width to a spacing between said pair of slots, said mounting structure having a thickness at least as small as a thickness of said pair of slots, such that said mounting structure can slide into said slots; and wherein said pair of slots are formed by a pair of brackets affixed to said front surface of said display plate, each said bracket including a riser extending perpendicularly away from said front surface of said display plate, and an overhang extending from an end of said riser opposite said front surface of said display plate and extending parallel to said front surface of said display plate, said overhang spaced from said front surface of said display plate by a height of said riser defining said thickness of said front surface of said display plate by a height of said riser defining said thickness of said pair of slots.

14. The apparatus of claim 13 wherein said mounting structure comprises a mounting plate including portions extending beyond a width of a hitch receiver insert which define ears of said mounting plate, said ears having tips defining extremities of said ears most distant from said receiver insert.

15. The apparatus of claim 14 wherein said ears of said mounting plate and said pair of slots are sized to have sufficiently similar thicknesses that a friction fit is provided between said pair of slots and said ears of said mounting plate.

16. The apparatus of claim 14 wherein at least one of said pair of slots and at least one of said ears includes complementally formed detents therein which align with each other when said receiver insert is positioned at a desired location relative to said display plate.

17. An apparatus for providing a display on a rear of a vehicle, the apparatus comprising in combination:

a display plate having a front surface opposite a rear surface, said rear surface capable of supporting a display thereon;

a pair of slots on said front surface of said display plate, said slots oriented substantially parallel to each other;

a vehicle coupling having a mounting structure between said slots similar in width to a spacing between said pair of slots, said mounting structure having a thickness at least as small as a thickness of said pair of slots, such that said mounting structure can slide into said slots; and wherein said mounting structure is a back plate of a top tab, said top tab having a top plate with a hole passing therethrough which is larger than a neck of a tow ball but smaller than the tow ball.

* * * * *